US011160310B2

(12) United States Patent
Qiu

(10) Patent No.: US 11,160,310 B2
(45) Date of Patent: Nov. 2, 2021

(54) ELECTRONIC CIGARETTE

(71) Applicant: CHANGZHOU JWEI INTELLIGENT TECHNOLOGY CO., LTD., Jiangsu (CN)

(72) Inventor: Weihua Qiu, Jiangsu (CN)

(73) Assignee: CHANGZHOU JWEI INTELLIGENT TECHNOLOGY CO., LTD., Jiangsu (CN)

( * ) Notice: Subject to any disclaimer, the term of this patent is extended or adjusted under 35 U.S.C. 154(b) by 330 days.

(21) Appl. No.: 16/151,519

(22) Filed: Oct. 4, 2018

(65) Prior Publication Data

US 2019/0069601 A1 Mar. 7, 2019

Related U.S. Application Data

(63) Continuation-in-part of application No. PCT/CN2017/078574, filed on Mar. 29, 2017.

(30) Foreign Application Priority Data

Apr. 5, 2016 (CN) ..... 201610205258.4

(51) Int. Cl.
*A24F 40/42* (2020.01)
*A24F 40/49* (2020.01)
(Continued)

(52) U.S. Cl.
CPC ..... *A24F 40/485* (2020.01); *A24F 40/42* (2020.01); *A24F 40/49* (2020.01); *A24F 15/015* (2020.01); *A24F 40/10* (2020.01)

(58) Field of Classification Search
CPC ..... A24F 40/42
(Continued)

(56) References Cited

U.S. PATENT DOCUMENTS 9,510,623 B2 * 12/2016 Tucker ..... A61M 11/042
9,700,075 B2 * 7/2017 Liu ..... A24F 47/008
(Continued)

FOREIGN PATENT DOCUMENTS

CN 201438944 U 4/2010
CN 203946392 U 11/2014
(Continued)

OTHER PUBLICATIONS

Machine Translation of WO 2015/039280 (Year: 2015).*
Machine Translation of WO 2015/088290 (Year: 2015).*
Machine Translation of WO 2011/026846 (Year: 2011).*

*Primary Examiner* — Eric Yaary
*Assistant Examiner* — Russell E Sparks
(74) *Attorney, Agent, or Firm* — Novick, Kim & Lee, PLLC; Allen Xue

(57) ABSTRACT

An electronic cigarette includes a body, a cover, a latching member, a clamping member, a pushing member, and an ejector pin. The side wall/end wall of the body has a liquid injection hole in communication with a liquid storage part arranged in the cavity of the body; the cover covers the liquid injection hole; the latching member is arranged on the body; the clamping member is arranged on the cover; and the latching member and the clamping member are mutually snapped to fix the cover on the body. The pushing member is arranged between the clamping member and the cover or at one end of the clamping; the ejector pin ejects the pushing member to enable the clamping member to move relative to the cover or enable the latching member to move relative to the body and thus unsnapping the latching member and the clamping member.

16 Claims, 11 Drawing Sheets

(51) Int. Cl.
*A24F 40/10* (2020.01)
*A24F 40/485* (2020.01)
*A24F 15/015* (2020.01)

(58) Field of Classification Search
USPC ..... 131/329
See application file for complete search history.

(56) References Cited

U.S. PATENT DOCUMENTS

| | | | | |
|---|---|---|---|---|
| 10,426,193 | B2 * | 10/2019 | Schennum | B65D 51/24 |
| 2007/0158630 | A1 * | 7/2007 | Lo | E04F 11/181 256/59 |

FOREIGN PATENT DOCUMENTS

| | | | | | |
|---|---|---|---|---|---|
| CN | 204362978 | U | | 6/2015 | |
| CN | 204409585 | U | | 6/2015 | |
| CN | 204599341 | U | | 9/2015 | |
| CN | 105192896 | A | | 12/2015 | |
| CN | 105212270 | A | | 1/2016 | |
| CN | 105686089 | A | | 6/2016 | |
| CN | 205547364 | U | | 9/2016 | |
| KR | 20150009908 | A | * | 1/2015 | B05B 11/0056 |
| WO | WO-2011026846 | A1 | * | 3/2011 | A24F 42/00 |
| WO | WO-2015039280 | A1 | * | 3/2015 | A24F 47/008 |
| WO | WO-2015088290 | A2 | * | 6/2015 | A24F 40/42 |
| WO | 2015150760 | A1 | | 10/2015 | |

* cited by examiner

ELECTRONIC CIGARETTE

FIELD OF THE TECHNOLOGY

The present disclosure relates to a technical field of electronic cigarette, and more particularly, relates an electronic cigarette to be opened with an ejector pin.

BACKGROUND

At present, the electronic cigarette is a mature alternative for cigarette in the market, it employs a battery to supply power for a heating unit in the atomizer, causing the heating unit to be electrically driven to heat up the tobacco liquid to generate smog, for user to obtain a smoke experience.

In the current electronic cigarette, a cover is employed to cover the injection hole for sealing the injection hole. When user wants to perform a liquid injection, merely the cover is opened. Due to such a simple operation, the cover is easily to be opened when child takes the electronic cigarette, thus the tobacco liquid or other similar substance stored in the liquid storage chamber can be contacted by child, thereby, it becomes a safety hazard for child.

SUMMARY

Directed to above shortcomings of the prior art, it is necessary to provide an electronic cigarette having a simple structure and difficult to be opened by child.

Aiming at aforementioned target, the invention is achieved by the following technical solutions:

An electronic cigarette to be opened by an ejector pin is provided. The electronic cigarette includes a main body, a cover, a latching member, and a clamping member. The main body defines an injection hole at a side wall/an end wall thereof, the liquid injection hole fluidly communicates with a liquid storing member in a chamber of the main body. The cover covers the liquid injection hole. The latching member is positioned on the main body. The clamping member is positioned on the cover. The latching member latches with the clamping member to secure the cover to the main body. The electronic cigarette further includes a pushing member and an ejector pin, the pushing member is positioned between the clamping member and cover or positioned on an end of the latching member, the ejector pin resists the pushing member, enabling the clamping member to move relative the cover or enabling the latching member to move relative to the main body, thereby releasing a latching between the latching member and the clamping member.

In an embodiment, the latching member is a latching protrusion protruding from the main body, the clamping member is positioned on an end of the cover, a gap is formed between the clamping member and the cover in advance to allow the clamping member to move toward or away from the cover, the pushing member is positioned in the gap, for blocking a movement of the clamping member toward the cover, when the ejector pin pushes the pushing member, the pushing member detaches from the gap, causing the clamping member to move toward the cover, thereby releasing a latching between the latching member and the clamping member.

In an embodiment, the cover is provided with a first elastic member, an end of the pushing member is connected to the first elastic member, under an elastic force, the pushing member is pushed into the gap, when the ejector pin resists the pushing member, the first elastic member is compressed, the pushing member detaches from the gap.

In an embodiment, an end of the clamping member defines a latching groove engaging the latching member, an opposite end of the clamping member is positioned on an end of the cover via a second elastic member, when the clamping member moves away from the cover and latches with the latching member, the second elastic member is in the strengthening state, when the clamping member detaches from the latching member, the clamping member moves under an elastic force of the second elastic member toward the cover.

In an embodiment, the electronic cigarette further includes a limiting member, wherein the limiting member protrudes from an end of the cover adjacent to the clamping member, a sidewall of an end of the clamping member which is connected to the second elastic member latches with the limiting member.

In an embodiment, a leveraged rotation shaft is positioned between the latching member and the pushing member, the latching member, the pushing member and the leveraged rotation shaft constitute a lever, the latching member, the pushing member and the leveraged rotation shaft serve as a resisting arm, a power arm, and a pivot, respectively, the clamping member is a groove defined on an end of the cover and faces the latching member, the cover defines a locking hole corresponding the pushing member, enabling the ejector pin to pass through the locking hole and push the pushing member, under a force, the pushing member moves toward the main body, the latching member moves away from the main body and resists the clamping member, thereby a latching between the latching member and the clamping member is released.

In an embodiment, a sidewall of the main body defines a receiving chamber, for receiving the cover, the liquid injection hole is defined on a bottom wall of the receiving chamber, an end of the cover adjacent to the clamping member is rotatably connected to the main body.

In an embodiment, an end of the cover adjacent to the clamping member is rotatably connected to the main body via a rotation shaft.

In an embodiment, the cover closely engages the receiving chamber.

In an embodiment, the receiving chamber further defines two securing holes, the two securing holes are positioned on opposite sides of the latching member, the cover is further provided with two securing plugs, the securing plug is corresponding to the securing hole and closely engage the securing hole.

In an embodiment, an upper portion of an end of the cover having the clamping member defines a forcing groove.

In an embodiment, the electronic cigarette further includes a sealing member protruding from a side of the cover facing the liquid injection hole.

The electronic cigarette of the invention to be opened with an ejector pin is provided with an ejector pin, when opening the cover, the ejector pin is required to resist the pushing member, enabling the clamping member to move relative the cover or enabling the latching member to move relative to the main body, thereby releasing a latching between the latching member and the clamping member. The electronic cigarette has a simple structure, and the following can be avoided: the cover is accidently opened by child, the tobacco liquid or other similar substance in the liquid storage chamber contacts the child via the liquid injection hole.

BRIEF DESCRIPTION OF THE DRAWINGS

The present disclosure is specifically illustrated with reference to accompanying drawings and embodiments in the following description.

Illustrations of the reference signs of accompanying drawings.

| | | | |
|---|---|---|---|
| main body | 1 | latching member | 11 |
| liquid injection hole | 12 | cover | 2 |
| clamping member | 21 | pushing member | 22 |
| first elastic member | 23 | latching groove | 24 |
| second elastic member | 25 | ejector pin | 3 |
| sealing portion | 26 | limiting member | 27 |
| main body | 1' | cover | 2' |
| ejector pin | 3' | securing hole | 10' |
| latching member | 11' | liquid injection hole | 12' |
| leveraged rotation shaft | 13' | locking hole | 22' |
| forcing groove | 23' | clamping member | 24' |
| sealing portion | 26' | pushing member | 25' |
| securing plug | 21' | | |

DETAILED DESCRIPTION

In order to clearly illustrate the technical solutions, creative features, purposes, and advantages for accomplishing the present disclosure, the following is further illustrated with reference to the detailed embodiment.

Figure 1:
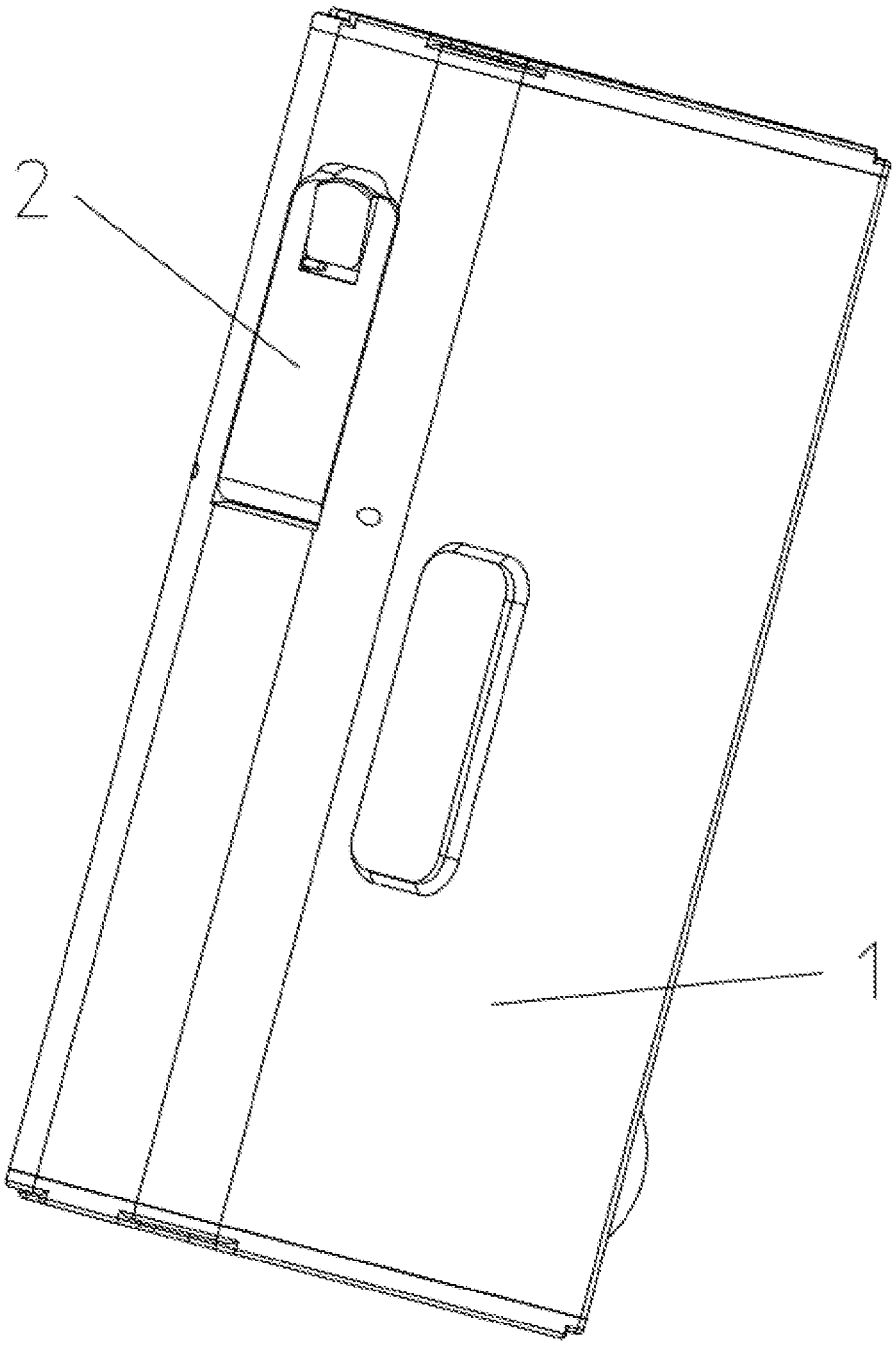
FIG. 1 is a schematic view of a first embodiment of the present disclosure.
Figure 2:
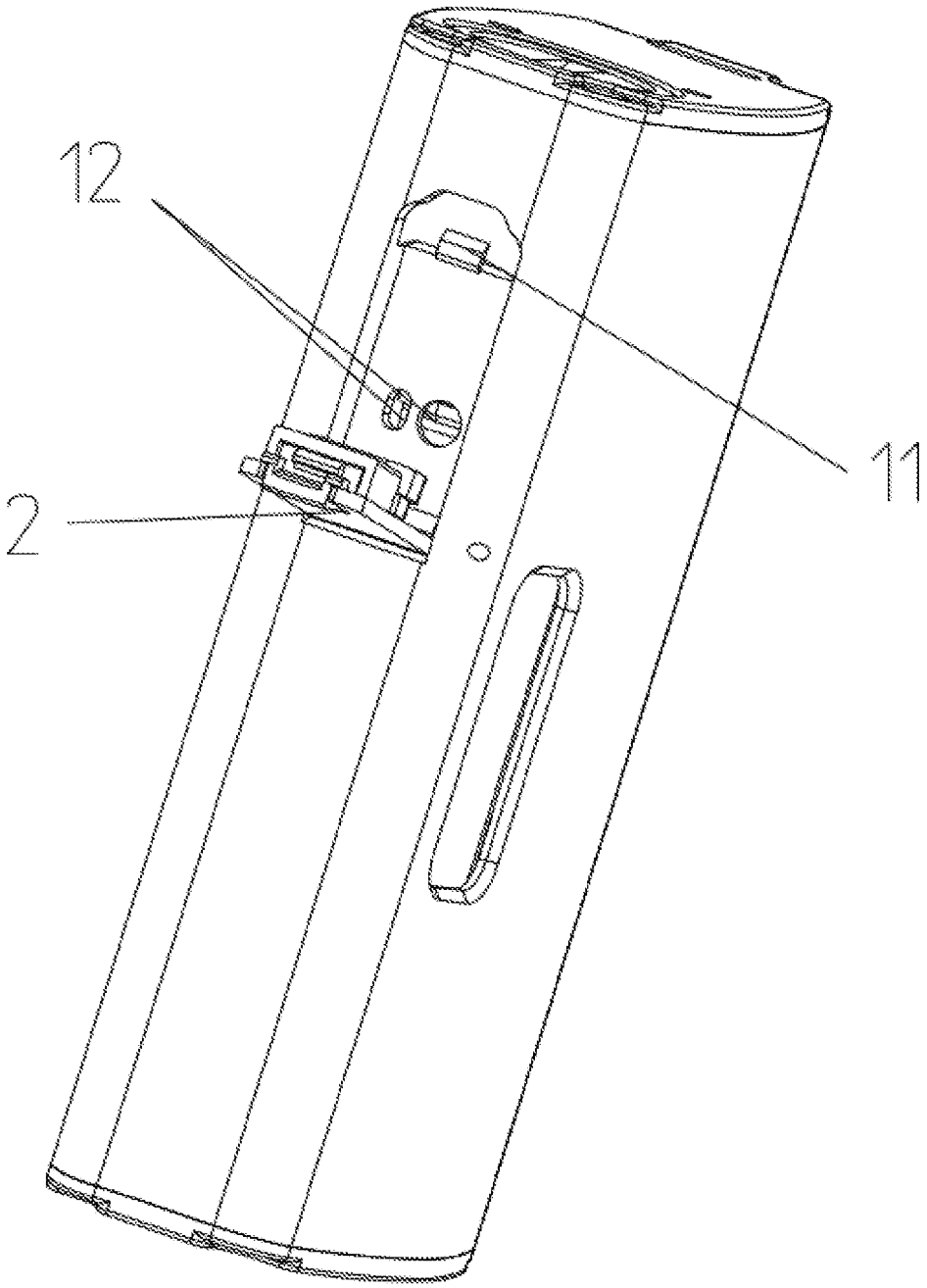
FIG. 2 is a schematic view of FIG. 1 when a cover is opened.
Figure 3:
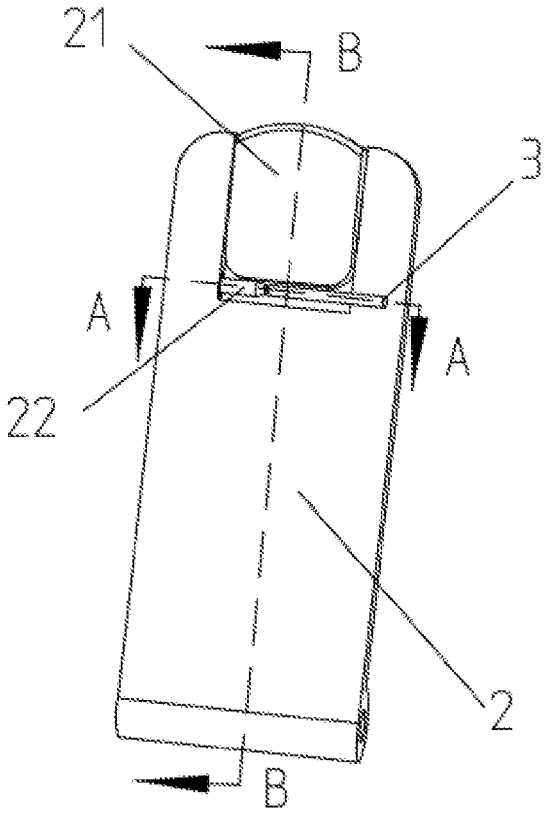
FIG. 3 is a schematic view of a cover of FIG. 1.
Figure 4:
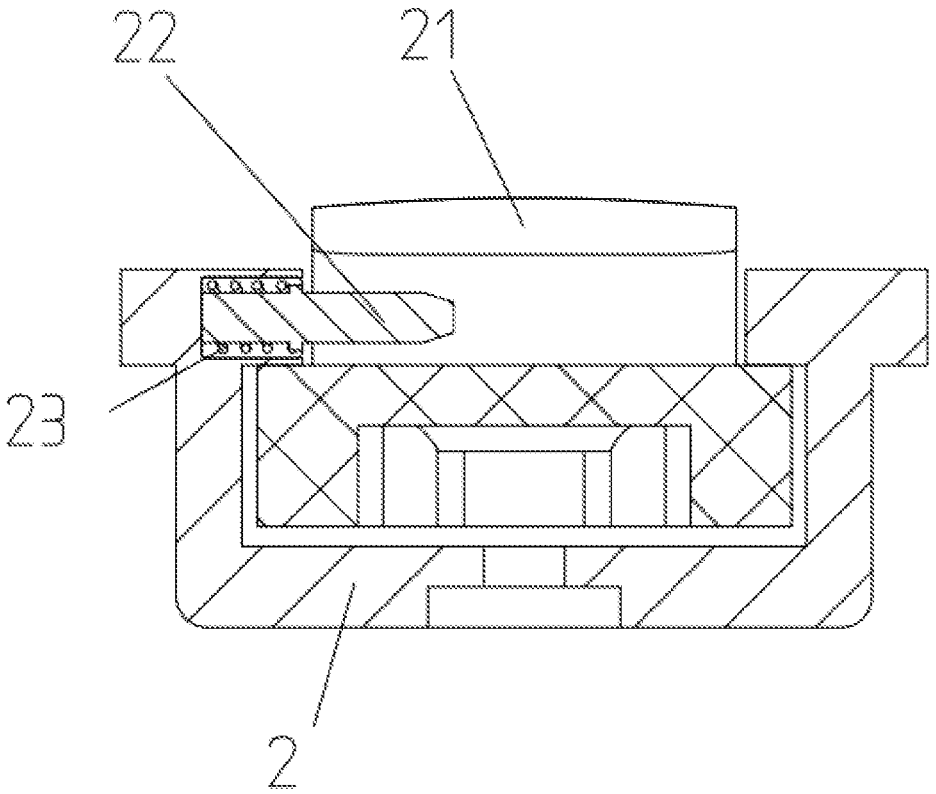
FIG. 4 is a cross-sectional view of the cover of FIG. 3, taken along line A-A.
Figure 5:
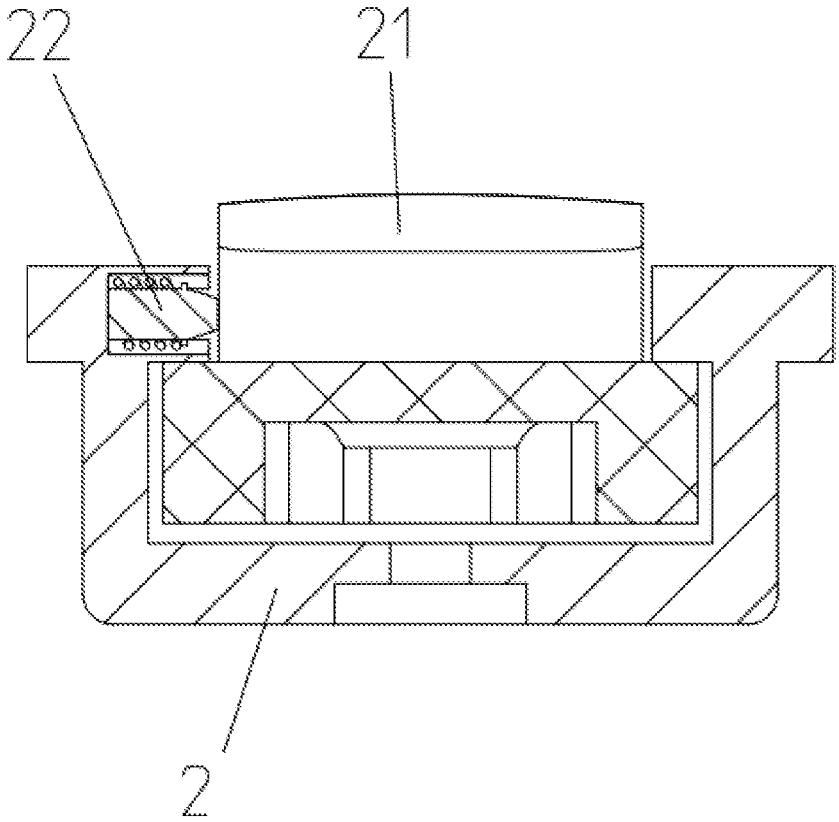
FIG. 5 is a cross-sectional view similar to FIG. 4, when an ejector pin is pushed to an end.
Figure 6:
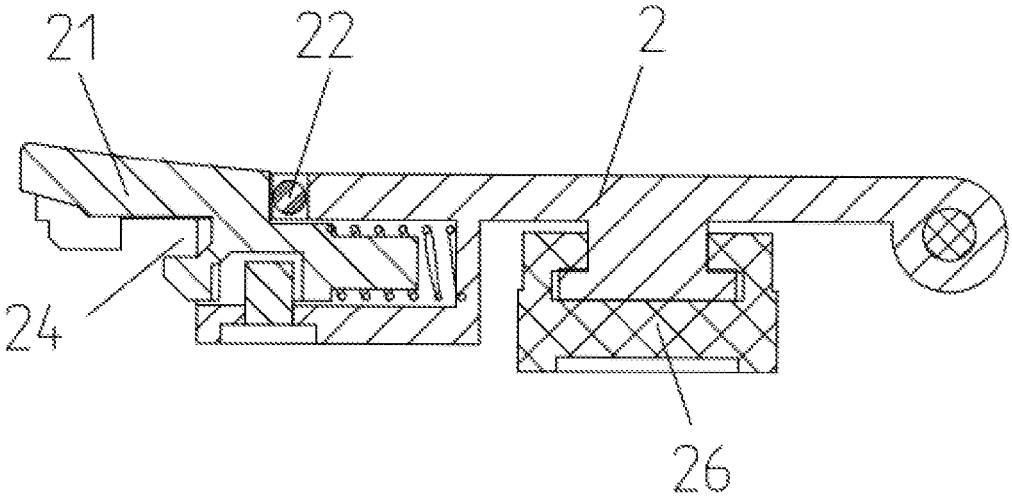
FIG. 6 is a cross-sectional view of the cover of FIG. 3, taken along line B-B.
Figure 7:
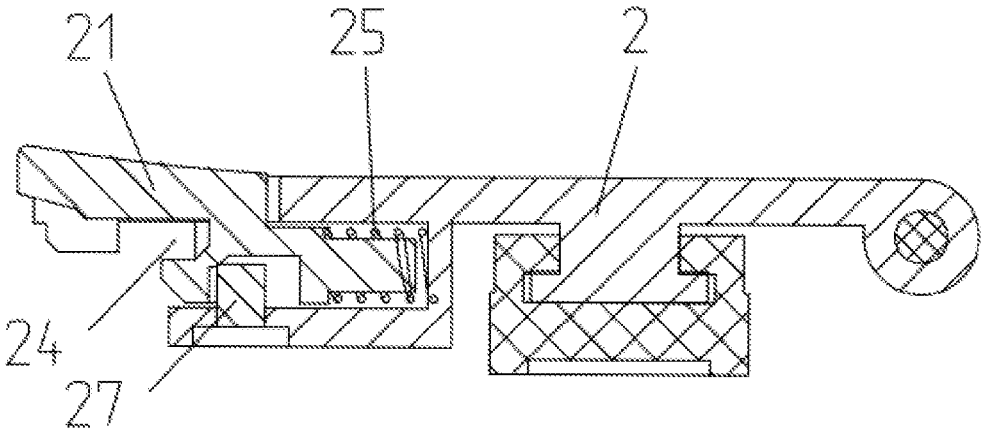
FIG. 7 a cross-sectional view similar to FIG. 6, when an ejector pin is pushed to an end.

FIG. 1 through FIG. 7 show a first embodiment of the present disclosure.

An electronic cigarette to be opened with an ejector pin, includes a main body 1, a cover 2, a latching member 11, a clamping member 21, a pushing member 22 and an ejector pin 3. A sidewall/end wall of the main body 1 defines an injection hole 12, the liquid injection hole 12 fluidly communicates with a liquid storing member in the chamber of the main body 1. The cover 2 covers the liquid injection hole 12, the latching member 11 is positioned on the main body 1, the clamping member 21 is positioned on the cover 2, the clamping member 21 latches with the clamping member 21 to secure the cover 2 to the main body 1, the pushing member 22 is positioned between the clamping member 21 and the cover 2. The ejector pin 3 resists the pushing member 22, enabling the clamping member 21 to move relative to the cover 2, thereby releasing a latching between the latching member 11 and the clamping member 21.

In the illustrated embodiment, the latching member 11 is a latching protrusion protruding from the main body 1. The clamping member 21 is positioned on an end of the cover 2, a gap is formed between the clamping member 21 and the cover 2 in advance, and allows the clamping member 21 to move toward or away from the cover 2. The pushing member 22 is positioned in the gap, for blocking a movement of the clamping member 21 toward the cover. When the user want to perform a liquid injection, the ejector pin 3 is employed to push the pushing member 22, the pushing member 22 detaches from the gap, causing the clamping member 21 to move toward the cover 2, thereby releasing the latching between the latching member 11 and the clamping member 21, thus the cover 2 is opened.

Further, the cover 2 is provided with a first elastic member 23, an end of the pushing member 22 is connected to the first elastic member 23, under an elastic force, the pushing member 22 is pushed into the gap, when the ejector pin 3 resists the pushing member 22, the first elastic member 23 is compressed, the pushing member 22 detaches from the gap.

Further, the clamping member 21 has a substantially Z shape, an end of the clamping member 21 defines a latching groove 24 engaging the latching member 11. An opposite end of the clamping member 21 is positioned on an end of the cover 2 via a second elastic member 25. The second elastic member 25 is pulled, the clamping member 21 moves away from the cover 2 and latches with the latching member 11. When the second elastic member 25 is compressed, the clamping member 21 moves toward the cover 2, and detaches from the latching member 11.

Further, the sidewall of the main body 1 defines a receiving chamber, for receiving the cover 2, the liquid injection hole 12 is defined on the bottom wall of the receiving chamber, an end of the cover 2 adjacent to the clamping member 21 is rotatably connected to the main body 1.

Further, an end of the cover 2 adjacent to the clamping member 21 is rotatably connected to the main body 1 via a rotation shaft.

Further, the electronic cigarette further includes a sealing member 26, the sealing member 26 protrudes from a side of the cover 2 facing the liquid injection hole 12, for sealing the liquid injection hole 12 to avoid a liquid leakage.

Further, the electronic cigarette includes limiting member 27, the limiting member 27 protrudes from an end of the cover 2 adjacent to the clamping member 21. A sidewall of an end of the clamping member 21 which is sleeved by the second elastic member 25 latches with the limiting member 27. The limiting member 27 is configured to avoid a detachment of the clamping member 21 from the cover 2, for restricting a movement range of the clamping member 21 relative to the cover 2.

When user wants to perform a liquid injection, the ejector pin 3 is employed to resist the pushing member 22, causing the pushing member 22 to detach from the gap, thereby pushing the clamping member 21 to move toward the cover 2, the clamping member 21 detaches from the latching member 11, thereby the cover 2 is opened to reveal the liquid injection hole 12. Because child can only perform some simple actions, it is difficult to envisage that an ejector pin 3 is required to push the pushing member 22, so as to allow the pushing member 22 to leave the gap, and then the clamping member 21 can be pushed to remove a latching between the clamping member 21 and the latching member 11, therefore the cover 2 is opened. Therefore, the following can be avoided: the cover is accidently opened by child, the tobacco liquid or other similar substance in the liquid storage chamber contacts the child via the liquid injection hole 12.

Figure 8:
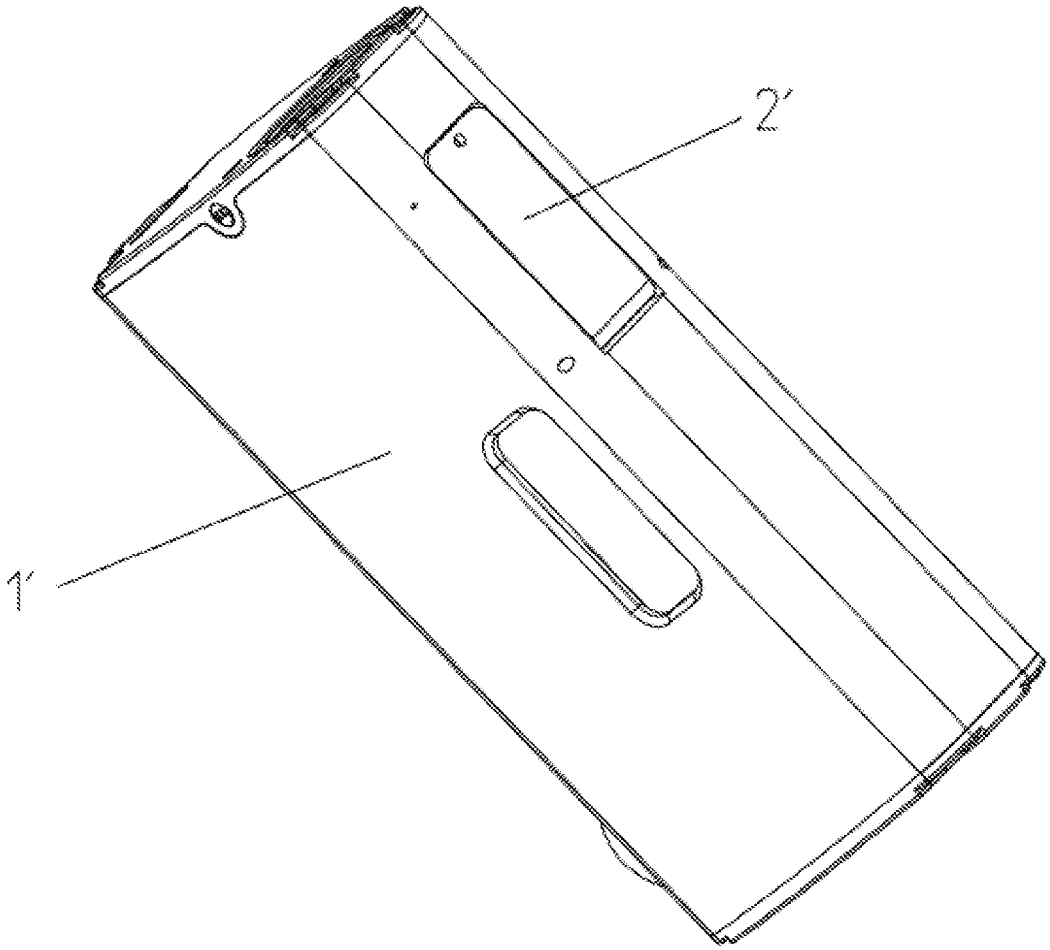
FIG. 8 is a schematic view of a second embodiment of the present disclosure.
Figure 9:
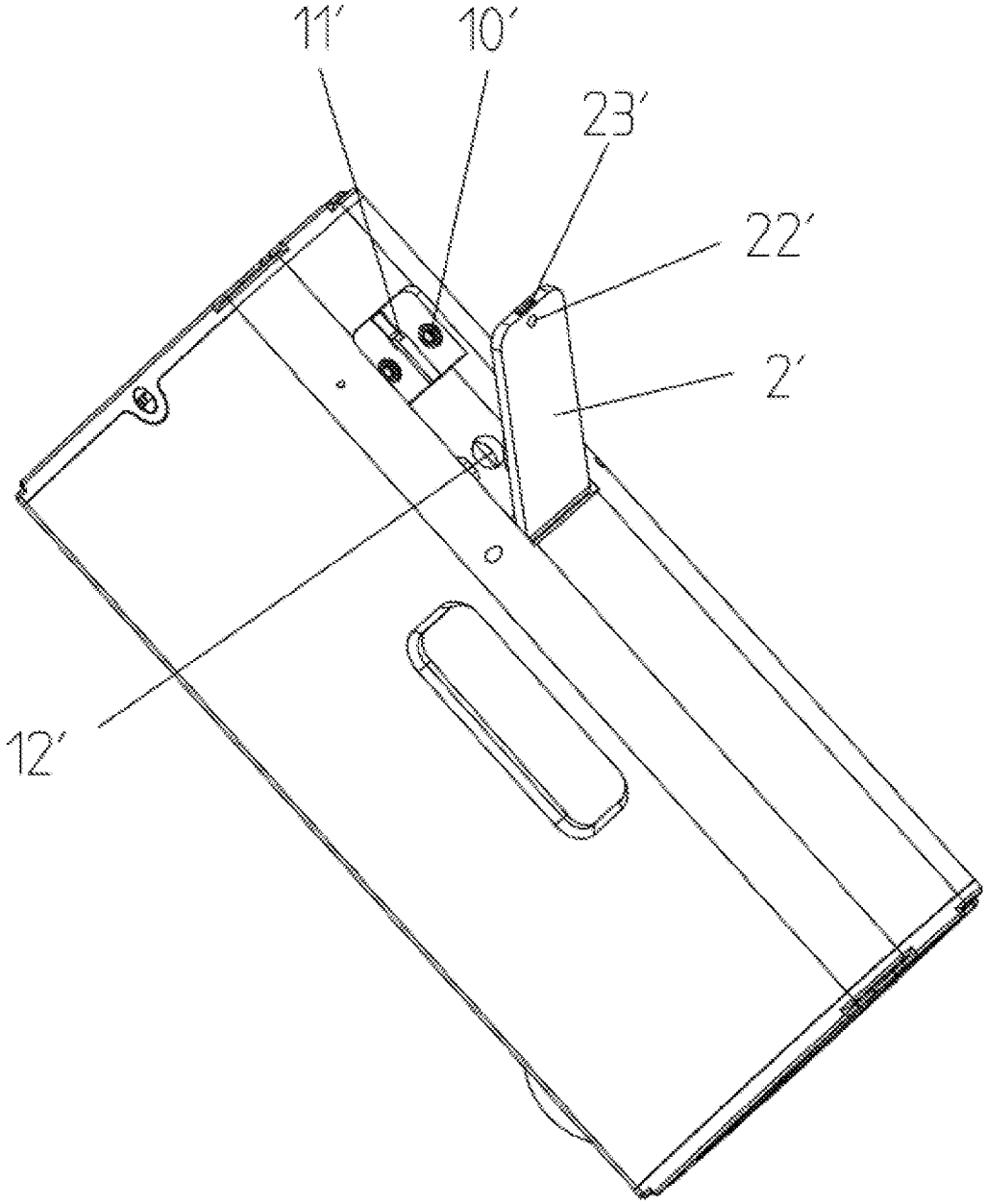
FIG. 9 is a schematic view of FIG. 8 when a cover is opened.
Figure 10:
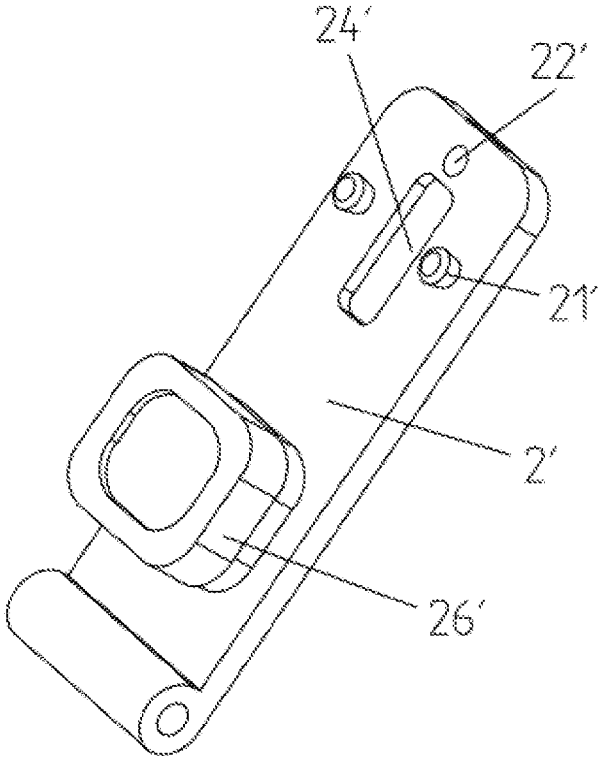
FIG. 10 is a schematic view of a cover of FIG. 8.
Figure 11:
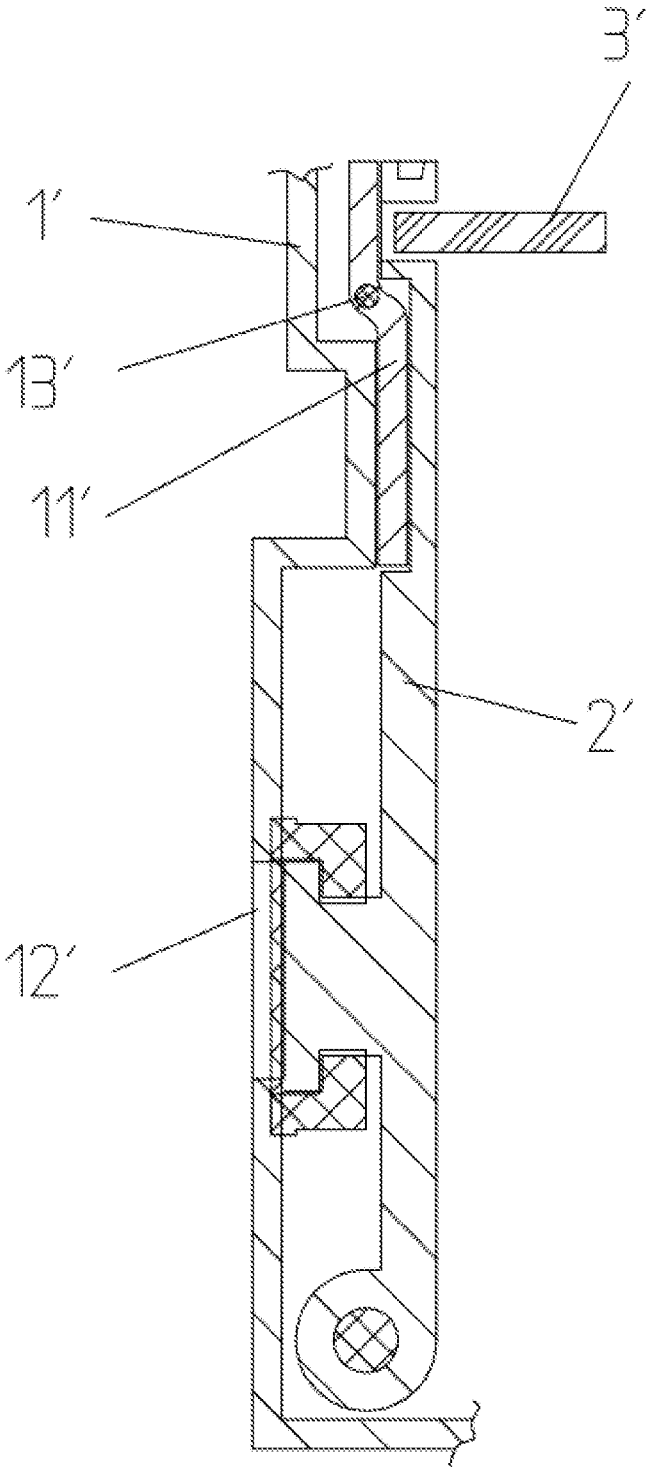
FIG. 11 is a cross-sectional view of a cover, a latching member, a clamping member, a pushing member, an ejector pin and a partial of a main body of FIG. 8.
Figure 12:
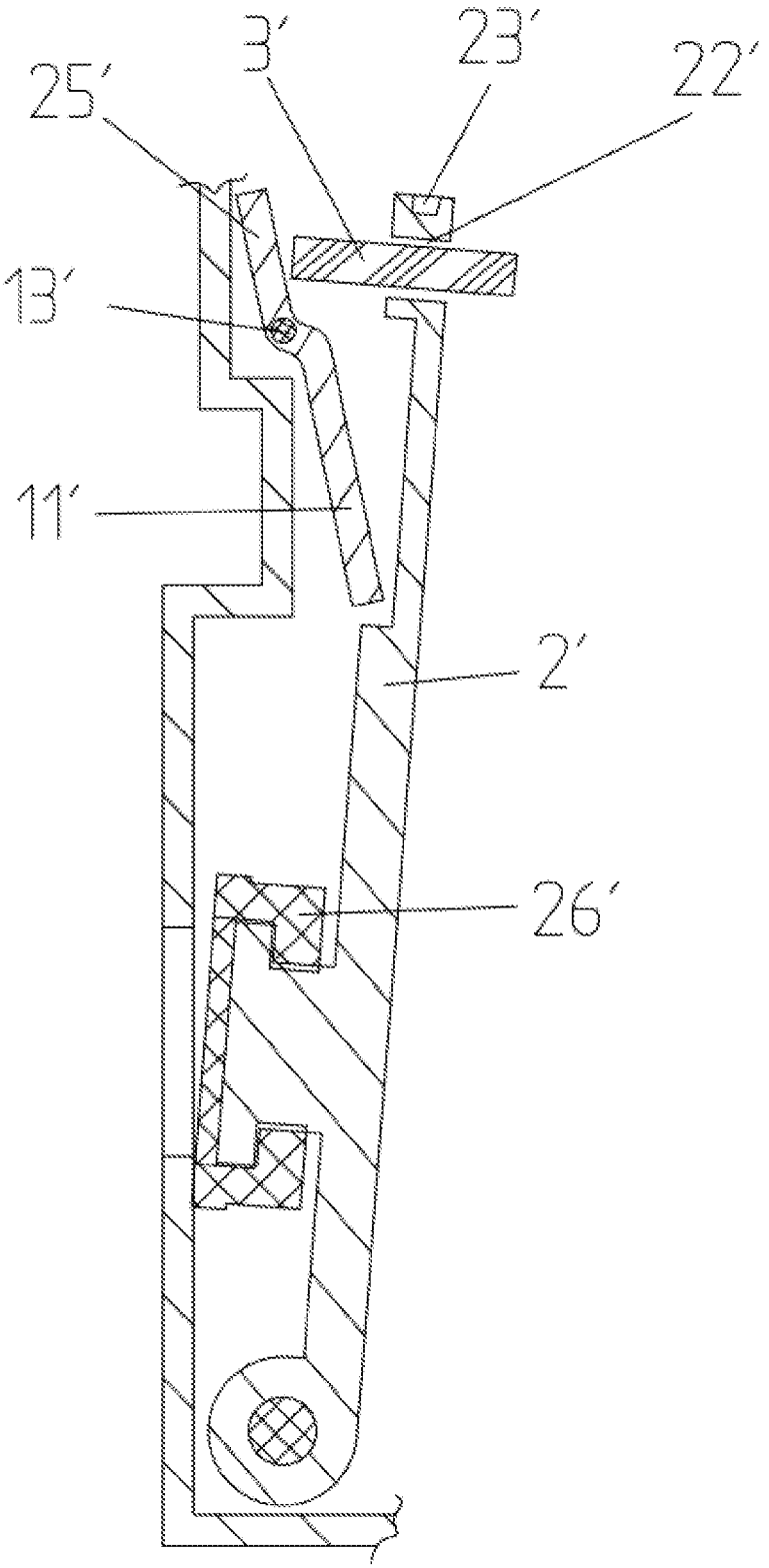
FIG. 12 is a cross-sectional view of a cover, a latching member, a clamping member, a pushing member, an ejector pin and a partial of a main body of FIG. 9.

FIG. 8 through FIG. 12 shows a second embodiment of the present disclosure:

An electronic cigarette to be opened with an ejector pin, includes a main body 1', a cover 2', a latching member 11', a clamping member 24', a pushing member 25' and an ejector pin 3'. A sidewall/end wall of the main body 1' defines an injection hole 12', the liquid injection hole 12' fluidly communicates with a liquid storing member in the chamber of the main body 1'. The cover 2' covers the liquid injection hole 12', the latching member 11' is positioned on the main body 1', the clamping member 24' is positioned on the cover 2', the latching member 11' latches with the clamping member 24' to secure the cover 2' to the main body 1', the pushing member 25' is positioned on an end of the latching member 11'. The ejector pin 3' resists the pushing member 25', enabling the latching member 11' to move relative to the main body 1', thereby releasing a latching between the latching member 11' and the clamping member 24'.

In the illustrated embodiment, a leveraged rotation shaft 13' is positioned between the latching member 11' and the pushing member 25'. The latching member 11', the pushing member 25' and the leveraged rotation shaft 13' constitute a lever, the latching member 11', the pushing member 25' and the leveraged rotation shaft 13' serve as a resisting arm, a power arm, and a pivot, respectively. The clamping member 24' is a groove defined on an end of the cover 2' and faces the latching member 11'. The cover 2' defines a locking hole 22' corresponding the pushing member 25', enabling the ejector pin 3' to pass through the locking hole 22' and push the pushing member 25'. Under a force, the pushing member 25' moves toward the main body 1', the latching member 11' moves away from the main body 1' and resist the clamping member 24', thereby the latching between the latching member 11' and the clamping member 24' is released.

Further, the sidewall of the main body 1 defines a receiving chamber, for receiving the cover 2', the liquid injection hole 12' is defined on the bottom wall of the receiving chamber, an end of the cover 2' adjacent to the clamping member 24' is rotatably connected to the main body 1'.

Further, an end of the cover 2' adjacent to the clamping member 24' is rotatably connected to the main body 1' via a rotation shaft.

Further, the cover 2' closely engages the receiving chamber, i.e. the gap between the cover 2' and the receiving chamber is too tiny, the normal tool cannot be inserted into the gap to pry the cover 2' for opening the cover 2'.

Further, the receiving chamber further defines two securing holes 10', the two securing holes 10' are positioned on opposite sides of the latching member 11', the cover 2' is further provided with two securing plugs 21' respectively corresponding to the two securing holes 10', causing the cover 2' not to fall down easily.

Further, an upper portion of an end of the cover 2' having the clamping member 24' defines a forcing groove 23', when the latching member 11' resists the clamping member 24' to drive at least a part of the cover 2' to detach from the receiving chamber, user can applies a force in the forcing groove 23', which facilitates for user to open the cover 2'.

Further, the electronic cigarette further includes a sealing member 26', the sealing member 26' protrudes from a side of the cover 2 facing the liquid injection hole 12, for sealing the liquid injection hole 12' to avoid a liquid leakage.

When user wants to perform a liquid injection, the ejector pin 3' is required to pass through the locking hole 22' and resist the pushing member 25', causing the latching member 11' to tilt and resists the cover 2', enabling at least a part of the cover 2' to detach from the receiving chamber, thus user can open the cover 2' to reveal the liquid injection hole 12'. Because child can only perform some simple actions, it is difficult to envisage that an ejector pin 3' is required to pass through the locking hole 22' to push the pushing member 25', so as to allow the latching member 11' to tilt and resist the cover 2', enabling at least a part of the cover 2' to detach from the receiving chamber, thus the cover 2' can be opened. Therefore, the following can be avoided: the cover 2' is accidently opened by child, the tobacco liquid or other similar substance in the liquid storage chamber contacts the child via the liquid injection hole 12'.

The electronic cigarette of the present disclosure to be opened with an ejector pin is provided with an ejector pin 3, 3', when opening the cover 2, 2', the ejector pin 3 is required to resist an end of the pushing member 22, causing the pushing member 22 to be retracted into the cover 2 and pushing the clamping member 21 to move toward the cover 2, thus enabling the latching member 11 to detach from the latching groove 24, and then the cover 2 can be opened. Or the ejector pin 3' is required to pass through the locking hole 22' and resists the pushing member 25', causing the pushing member 25' to rotate along the leveraged rotation shaft 13', the latching member 11' resists the cover 2', such that the cover 2' can be opened. The electronic cigarette has a simple structure, and the cover 2, 2' cannot be easily opened by child.

The foregoing is considered as illustrative only of the principles and characteristic of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. An electronic cigarette, comprising:

a main body defining an injection hole at a sidewall or an end wall thereof, wherein the liquid injection hole fluidly communicates with a liquid storing member in a chamber of the main body;

a cover pivotally connected to the main body, wherein the cover, when in a closed position, covers the liquid injection hole, when in an open position, exposes the liquid injection hole;

a latching member positioned on the main body;

a clamping member positioned on the cover;

wherein the latching member engages the clamping member when the cover is in the closed position;

a pushing member; and an ejector pin, wherein the pushing member is movably positioned between the clamping member and the cover or positioned on an end of the latching member, wherein, under an external force, the ejector pin pushes the pushing member, enabling the clamping member to move relative to the cover or enabling the latching member to move relative to the main body, thereby disengaging the latching member and the clamping member to release the cover from the closed position.

2. The electronic cigarette according to claim 1, wherein the latching member is a latching protrusion protruding from the main body, the clamping member is pivotally disposed on an end of the cover, a gap is formed between the clamping member and the cover to allow the clamping member to pivot toward or away from the main body, when the cover is in the closed position, the pushing member is disposed in the gap and prevents the clamping member from pivoting away from the main body, when the cover is in the open position, the pushing member is pushed out from the gap to allow the clamping member to pivot away from the main body.

3. The electronic cigarette according to claim 2, wherein one end of the pushing member is connected to a first elastic member, wherein the first elastic member is compressed when the pushing member is pushed out from the gap.

4. The electronic cigarette according to claim 2, wherein the clamping member defines a latching groove configured to engage the latching member, the clamping member is positioned on the end of the cover via a second elastic member, wherein the second elastic member is in a compressed state when the clamping member is disengaged from the latching member or in a decompressed state when the clamping member engages the latching member.

5. The electronic cigarette according to claim 4, further comprising a limiting member, wherein the limiting member protrudes from an end of the cover adjacent to the clamping member, a sidewall of an end of the clamping member connected to the second elastic member engages with the limiting member when the second elastic member is in a decompressed state.

6. The electronic cigarette according to claim 1, wherein a leveraged rotation shaft is positioned between the latching member and the pushing member, the latching member, the pushing member and the leveraged rotation shaft constitute a lever, the latching member, the pushing member and the leveraged rotation shaft serve as a resisting arm, a power arm, and a pivot, respectively, the clamping member is a groove defined on an end of the cover and faces the latching member, the cover defines a locking hole corresponding to the pushing member, enabling the ejector pin to pass through the locking hole and push the pushing member, under a force, the pushing member moves toward the main body, the latching member moves away from the main body and resists the clamping member, thereby a latching between the latching member and the clamping member is released.

7. The electronic cigarette according to claim 2, wherein the sidewall of the main body defines a receiving chamber for receiving the cover, the liquid injection hole is defined on a bottom wall of the receiving chamber, an end of the cover adjacent to the clamping member is pivotably connected to the main body.

8. The electronic cigarette according to claim 7, wherein an end of the cover adjacent to the clamping member is pivotably connected to the main body via a shaft.

9. The electronic cigarette according to claim 7, wherein the cover in the closed position engages the receiving chamber.

10. The electronic cigarette according to claim 7, wherein the receiving chamber further defines a first and a second securing holes respectively positioned on opposite sides of the latching member, the cover is further provided with two securing plugs, each securing plug engaging the first securing hole or the second securing hole.

11. The electronic cigarette according to claim 6, wherein a sidewall of the main body defines a receiving chamber, for receiving the cover, the liquid injection hole is defined on a bottom wall of the receiving chamber, an end of the cover adjacent to the clamping member is rotatably connected to the main body.

12. The electronic cigarette according to claim 11, wherein an end of the cover adjacent to the clamping member is rotatably connected to the main body via a rotation shaft.

13. The electronic cigarette according to claim 11, wherein the cover engages the receiving chamber.

14. The electronic cigarette according to claim 11, wherein the receiving chamber further defines two securing holes, the two securing holes are positioned on opposite sides of the latching member, the cover is further provided with two securing plugs, each securing plug corresponding to a securing hole and engaging the securing hole.

15. The electronic cigarette according to claim 6, wherein an upper portion of an end of the cover having the clamping member defines a forcing groove.

16. The electronic cigarette according to claim 1, further comprising a sealing member protruding from a side of the cover facing the liquid injection hole.

* * * * *